United States Patent [19]

Taylor

[11] 4,286,440

[45] Sep. 1, 1981

[54] COMPARTMENT COOLER

[76] Inventor: Frank Taylor, 9415 Central Ave., Lasalle, Quebec, Canada, H8R2K4

[21] Appl. No.: 81,375

[22] Filed: Oct. 3, 1979

[51] Int. Cl.[3] ..... F25D 3/08

[52] U.S. Cl. ..... 62/457; 62/371; 62/530; 220/902; 206/541; 206/545

[58] Field of Search ..... 62/370, 371, 457, 529, 62/530; 220/902; 206/541, 545

[56] References Cited

U.S. PATENT DOCUMENTS

| | | | |
|---|---|---|---|
| 1,960,747 | 5/1934 | Marks | 62/457 X |
| 1,979,222 | 10/1934 | Goodwin | 62/457 X |
| 2,225,792 | 12/1940 | Nicholls | 62/457 X |
| 2,239,128 | 4/1941 | Sykes | 62/457 X |
| 2,393,245 | 1/1946 | Hadsell | 62/457 X |
| 2,496,296 | 2/1950 | Lobl | 62/530 X |
| 2,562,108 | 7/1951 | Lutz | 62/457 X |
| 3,156,105 | 11/1964 | Bahner | 62/457 X |
| 3,187,518 | 6/1965 | Bair et al. | 62/530 X |
| 3,255,607 | 6/1966 | Bair et al. | 62/457 X |
| 3,387,650 | 6/1968 | Hoffmann et al. | 62/371 X |
| 3,605,435 | 9/1971 | Taylor | 62/265X |

FOREIGN PATENT DOCUMENTS

| | | | |
|---|---|---|---|
| 209569 | 1/1955 | Australia | 62/457 |

*Primary Examiner*—Lloyd L. King

[57] ABSTRACT

A cooler is divided by an insulated partition into at least two separate compartments and a coolant container is positioned on the partition so that one surface of the coolant container is in direct communication with one of said compartments and a separate surface of the coolant container is in direct communication with at least one other of the compartments. Preferably the coolant container forms a removable closure for said one compartment.

9 Claims, 8 Drawing Figures

COMPARTMENT COOLER

FIELD OF THE INVENTION

This invention relates to portable coolers used to carry food and beverages to picnics and similar outings, which coolers are generally constructed of either moulded polyfoam or hard-shell plastic with foamed-in-place urethane insulation, and more particularly to significant improvements in the design and performance of such coolers.

PRIOR ART

Coolers of these types are generally rectangular in shape and are comparised simply of a moulded box shape with matching lid. The food and drink items to be kept cold are normally chilled prior to placement in the cooler and in most cases a cold pack, which has been pre-frozen, materially assists in keeping the cooler contents at a reasonably cool temperature for the period desired.

In actual practice, however, such an arrangement does not develop optimum efficiency for any given size of cold pack and cooler, for the reason that the food and drink items are placed in the cooler together, generally in random fashion, and the ice pack laid on top of the cooler contents. When packed in this manner the heat absorption capability of the cold pack may be severely restricted due to the cold air generated by the cold pack not being capable of flowing freely by natural convection around the items in the cooler, but rather providing a relatively high degree of cooking to the items in close proximity or contact with the cold pack but comparatively less cooling power to the items not in close proximity or contact with the cold pack. Therefore, as probably occurs in most cases where both food and bottled or canned beverages are placed together in such coolers, the benefit of the cold pack is limited and the food items, generally at a warmer temperature than the canned or bottled beverages, will lose heat to such beverages and cause their temperature to rise undesirably. Furthermore, this lose of cooling power is obviously compounded every time the cooler lid is removed to obtain a cold drink. Ideally, if the beverage containers were separated from the food items and arranged in a manner which would permit the continuous flow of cold convection air currents around each and every beverage container, much more efficient cooling of the beverages would result; the ultimate objective, of course, should keep the temperature of such beverages as close as possible to refrigerator temperature, approximately 40° F. for a prolonged period of time, while at the same time the food temperature should not be affected every time the cooler lid is removed to obtain a cold drink.

The food items, assuming they have been chilled somewhat prior to being placed in the cooler, need not be kept as cold as the beverages for there is little pleasure in eating cold food at refrigerator temperature, but it should be kept cool enough to maintain freshness and prevented from drying out. When food items, such as sandwiches, are wrapped in waxed paper or polybags as is now common practice, freshness is maintained and moisture loss is restricted for some time. Temperature control, while beneficial, is not required to high degree and an environment of 60° F. or slightly less is quite adequate to prevent food spoilage for a period of five or six hours.

BROAD DESCRIPTION OF THE PRESENT INVENTION

It is therefore, the main object of the present invention to provide a design of cooler in which it is possible, employing only one common cold pack, to segregate one portion of the cooler from another portion of the cooler and thereby to permit one portion of the cooler to be kept at a different temperature than that of another portion of the cooler.

It is also an object of the present invention to provide in a cooler a beverage section separate from the food section in which the beverages are subjected to a continuous contact with cold convection air current from the cold pack to ensure the minimum possible temperature of such beverage is maintained.

It is also an object of the present invention to provide in such a cooler means by which there is little or no transfer of heat from the food section of the cooler to the beverage section.

It is also an object of the present invention to provide in such a cooler means by which it is possible to remove the lid of such cooler to remove one or more beverages without disturbing the food section.

Broadly the present invention comprises an insulated container, means partitioning the interior of the container into at least two compartments, a coolant means, said coolant means having a portion of its surface exposed to one of said compartments and another portion of its surface exposed to at least another of said chambers, thereby to transfer heat from said one and said other compartment to different areas of said coolant means. In the preferred arrangement, the coolant means comprises a coolant container that forms a closure for at least said one compartment.

BRIEF DESCRIPTION OF THE DRAWINGS

Further features, objects and advantages will be evident to those skilled in the art from the following detailed description taken in conjunction with the accompanying drawings in which.

DESCRIPTION OF THE PREFERRED EMBODIMENT

Figure 1:
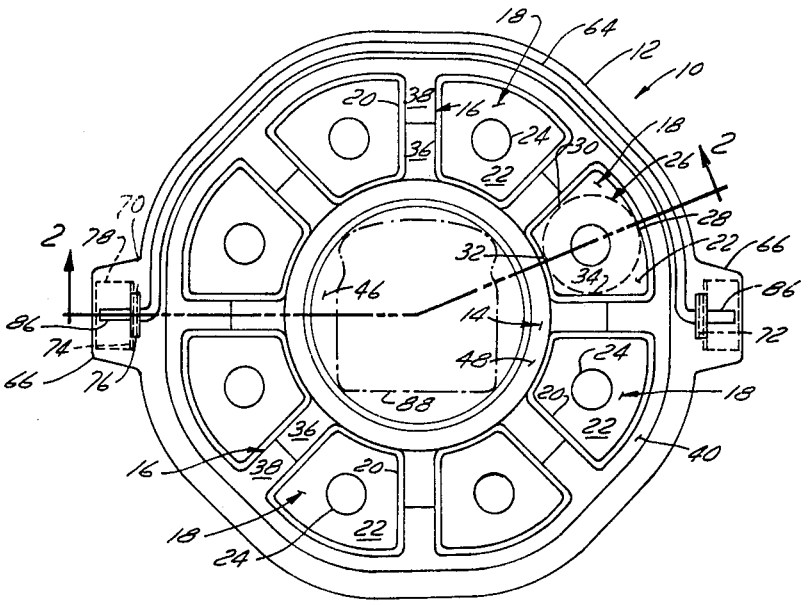
FIG. 1 is a plan view of one embodiment of a cooler constructed in accordance with the present invention with the lid and coolant container removed.
Figure 2:
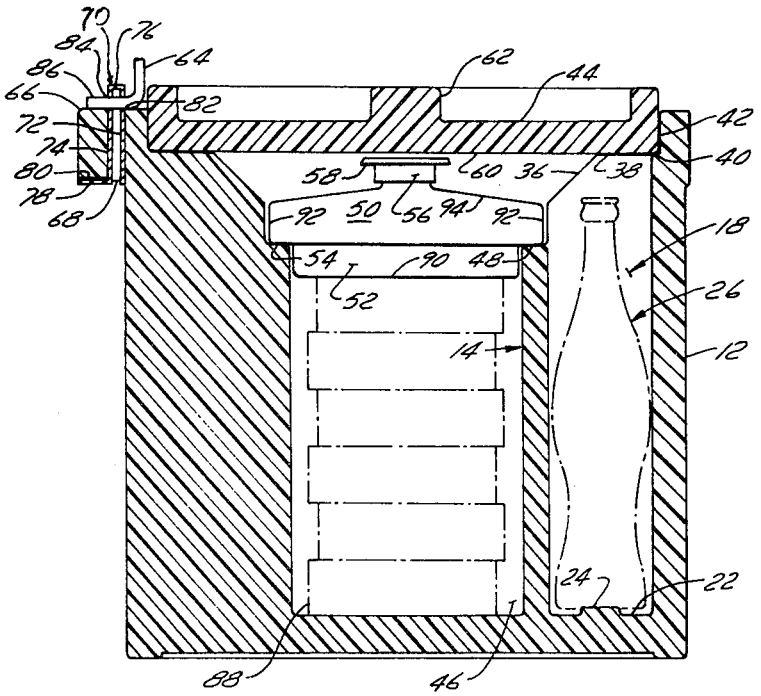
FIG. 2 is a section along the line 2—2 of FIG. 1 with the coolant container and lid in position.

In FIGS. 1 and 2, there is shown an octagonal container 10 having an insulated outer or peripheral wall 12 and an annular inner partition wall 14 with the space between the walls 12 and 14 divided by partition walls 16 (8 such walls) into 8 compartments 18. Each compartment 18 is tapered from a larger opening at the top to a smaller area at the bottom to facilitate moulding and each is provided at the bottom 22 with a suitable pedestal 24 to support the container such as the bottle 26 illustrated in the right hand compartment of FIG. 2 above the floor or bottom 22 to permit air circulation around the container. Also to ensure such circulation, the compartments 18 are shaped to contact the bottles 26 to be stored therein only at spaced points for example, as indicated in FIG. 1 at 28, 30, 32, 34 and permits air circulating between these points around and under the bottles.

The partition walls 16 in the illustrated arrangement each have a tapered section 36 and an upper section 38 substantially parallel to the bottom of the cooler. The upper section 38 is aligned with the bottom 40 of a notch 42 formed in the peripheral wall and adapted to seat the insulated lid 44 for the cooler. The tapered section 36 facilitates gripping of a bottle or the like in the compartments 18.

The inner partition wall 14 is also formed of insulating material and insulates an inner central compartment 46 from the peripheral compartments 18. The wall 14 tapers, it being thinner at the top than at the bottom to facilitate molding and has its top end 48 positioned well below the tapered section 36 so that the compartments 18 are in direct communication with the central portion of the cooler above the wall 14.

The upper surface 48 provides a seat to support the coolant means in the central portion of the cooler. In this embodiment the coolant means takes the form of a circular container 50 having a stepped section 52 adapted to be telescoped within the compartment 46 and to provide an annular seat 54 adapted to rest on the top 48. The coolant container 50 is provided with a suitable closure cap 56 which in the illustrated arrangement has a wide upper flange 58 which is positioned immediately adjacent the bottom 60 of the lid 44 and provides support for the lid 44 if it is deflected into the cooler and more important provides a handle for lifting the container 50.

The lid 44 is provided with a centre bar 62 that functions as a reinforcing and as handle.

The cooler 10 may be provided with a carrying bale 64 which in the illustrated arrangement is mounted on the cooler via a pair of projections 66. Each projections 66 is provided with a slot 68 through which a V-shaped member 70 is projected. Each member 70 is formed by a pair of legs 72 and 74 interconnected with a base member 76. The leg 74 (farthest from the cooler wall 12) is provided with a support flange 78 extending substantially perpendicular to the leg 74 and adapted to contact the bottom 80 of the projections. As illustrated in FIG. 2, the two legs 72 and 74 project up through the slots 68 and are provided adjacent the base 76 with aperatures 82 and 84 adapted to receive an end 86 of the bale 64.

In the FIG. 1 embodiment as illustrated, suitable beverages may be stored in the compartments 18 and sandwiches 88 or the like in the central well or compartment 46. The coolant container 50 absorbs heat from the compartment 46 through the area (bottom 90) exposed to that compartment while heat from the compartment 18 is absorbed through the peripheral wall 92 and top 94 of the container 50. It will be apparent that convection currents are set up in the compartments 18 and that the warm air rises along the outer surface of the compartment and colder air moves down adjacent the wall 14 thereby to maintain the beverages in the compartments cool.

Normally the beverages are consumed before the food and it will be noted, removal of the lid 44 provides direct access to the beverages in containers 26. The coolant container 50 forms a lid for the central well 46 and it, as well as the lid 44, must be removed to gain access to the well or compartment 46.

Figure 3:
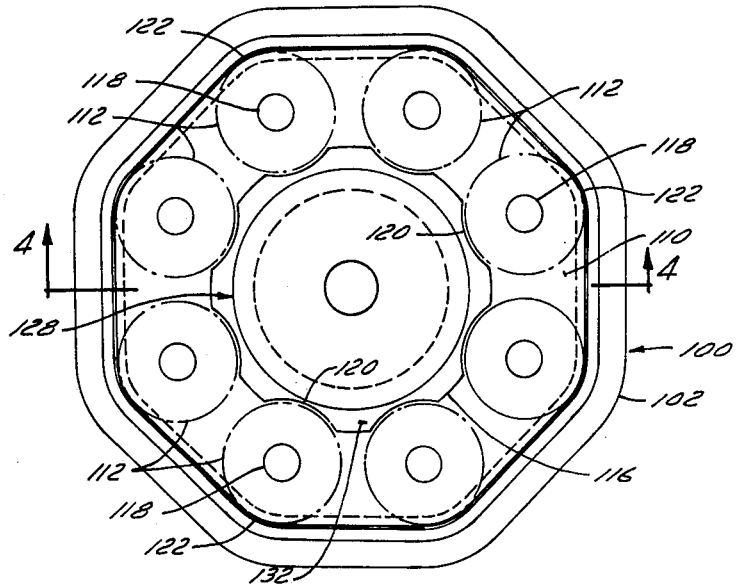
FIG. 3 is a plan view of another embodiment of the present invention with the lid removed.
Figure 4:
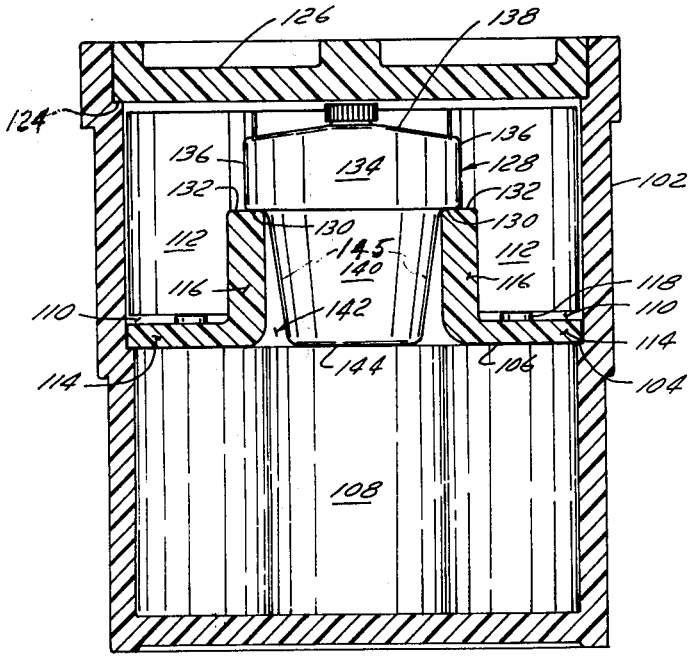
FIG. 4 is a section along the line 4—4 of FIG. 3 with the coolant container and lid in position.

The embodiment of FIGS. 3 and 4 utilizes the same concept as the FIGS. 1 and 2 embodiment, however, in the arrangement the cooler 100 is provided with an octagonal insulated outer wall 102 forming an annular shelf 104 adapted to support a discrete rack 106 preferably made of insulating material and forming a partition between a bottom chamber 108 and a substantially annular upper trough 110 (see FIG. 4) adapted in the illustrated arrangement to receive canned beverages or the like 112 as indicated by the dot-dash lines in FIG. 3.

The rack 106 has a bottom wall 114 and an annular inner wall 116 projecting upward substantially perpendicular to the bottom wall 114. The bottom wall 114 is provided on its upper side with projections 118 equivalent to the projections 24 of the FIG. 1 embodiment and adapted to function in a similar manner to support the containers 112 and facilitate air convection currents for cooling. In the arrangement illustrated, the annular wall 116 has its outer periphery scooped out in discrete curves as indicated at 120 in a manner to accommodate an adjacent side of a container 112 with the opposite side of the container received in the curvatures 122 forming the inner corners of the wall 102.

A second shelf 124 is provided at the mouth of the cooler 100 to seat the insulated lid 126 which is similar to the lid 44 of the previously described embodiment.

A cooling container 128 is formed with an annular seat 130 adapted to rest on the upper edge 132 of the annular wall 116 of the rack 106. The upper section 134 of the container 128 has a peripheral wall 136 in close proximity to the containers 112 and an upper wall 138 also exposed to the trough 110 so as to cool the containers in a similar manner to that described above in relation to the FIGS. 1 and 2 embodiment. A tapered lower section 140 is received within the space 142 defined by the annular wall 116 and has its bottom 144 and tapered side walls 145 in direct communication with the chamber 108 to absorb heat therefrom.

The embodiment of FIGS. 3 and 4 operates in the same manner as that of FIGS. 1 and 2. To reach the containers 112 and lid 126 must be removed but this does not disturb the contents of the chamber 108. To remove or insert things into the chamber 108 requires removal of both the lid 126 and the coolant container 128 and for larger things the rack 106 as well.

The FIGS. 5 to 8 embodiment is also quite similar to the previous embodiments but the shape of the cooler has been changed as well as the position of compartments.

Figure 5:
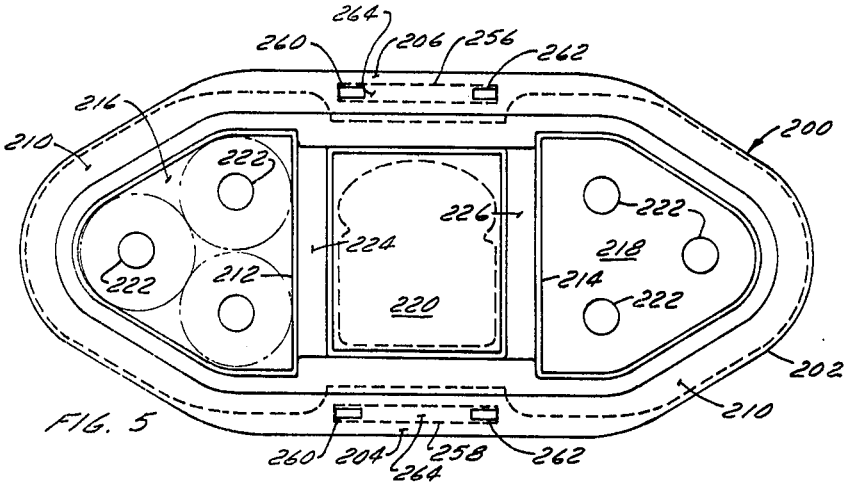
FIG. 5 is a plan view of yet another embodiment of the present invention with the lid and coolant container removed.
Figure 6:
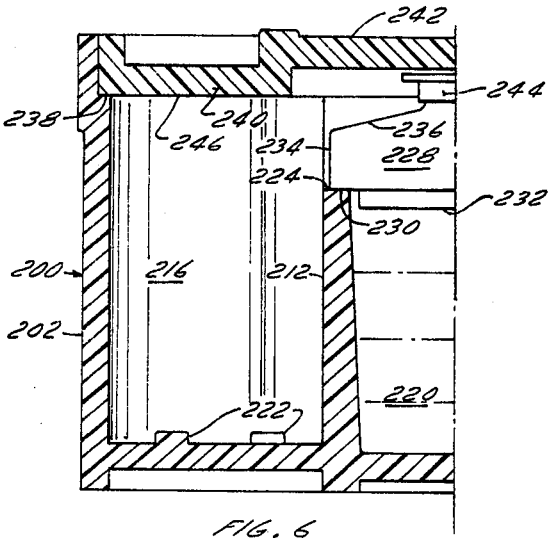
FIG. 6 is a longitudinal partial section through the centre of the embodiment of FIG. 5 with the coolant container and lid in position.
Figure 8:
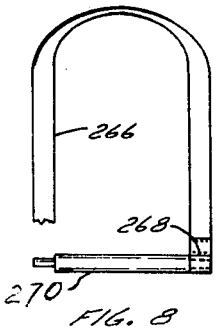
FIG. 8 is a side view with a portion broken away of one of the carrying straps for the FIG. 5 embodiment.
Figure 7:
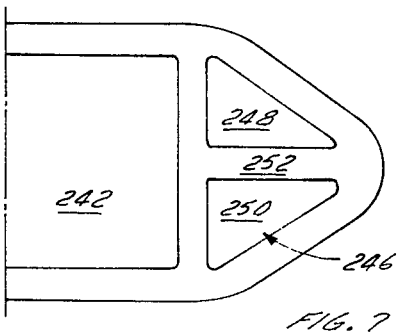
FIG. 7 is a partial plan view of the lid for the FIG. 5 embodiment.

As shown in FIGS. 5 and 6, the cooler 200 is provided with an insulated outer wall 202 having two substantially parallel sides 204 and 206 interconnected at their adjacent ends by V-shaped or U-shaped sections 210. Transverse partitions 212 and 214 divide the interior of the cooler 200 into two tapered or triangular compartments 216 and 218 with an intermediate rectangular compartment 220 therebetween. The partitions 212 and 214 project from the bottom but terminate well below the top of the wall 202, and the compartments 216 and 218 are provided with projections 222 equivalent to projections 118 and 24.

The top edges 224 and 226 of the partitions 212 and 214 provide a support for the coolant container 228 that is stepped at a pair of opposite sides to provide seats 230 (only one shown) to rest on the surfaces 224 and 226 with a portion 232 of the coolant container 228 projecting into the inner chamber 220. The periphery 234 and top 236 of the container cool the chambers 216 and 218.

The wall 202 is stepped adjacent its upper edge to provide a seat 238 for the lid 240. The lid is formed with a central rectangular section 242 raised to provide a space 243 to accommodate the lid 244 of container 228 and to facilitate air flow from the compartments 216 and 218 around the coolant container 228 and with triangular end sections 246 each which are formed with a pair of recesses 248 and 250 which define opposite sides of a handle forming bar 252 for gripping and lifting the lid 240.

The FIGS. 5 to 8 embodiments is provided with a pair of sling handles which are mounted in upper flanges 256 and 258 exiting across the sides of the cooler on opposite sides of the central compartment 220. A pair of apertures 260 and 262 are formed in each of these flanges 256 and 258 and a slot 264 indicated by dotted lines in FIG. 5 inter connects these aparatures on the bottom of the flanges 256 and 258. The each sling handle is formed by flexible strap 266 having loops 268 formed at each end thereof. The looped ends 268 are passed downward one through a hole 260 and the other through the hole 262 and the ends of a dowel pin 270 is received within the loop ends 268. The strap 266 is then pulled up to pull the dowel into the slot 264 wherein it is snugly received and up against the bottom of the slot 264 thereby to anchor each sling 266 in position.

It will be apparent that the cooler of FIGS. 5 to 8 operates in the same manner as the previously described coolers and that by simply doubling the depth of the cooler the capacity will be doubled i.e. two canned beverages could be piled one on top of the other.

Modifications may be made without departing from the spirit of the invention as defined in the appended claims.

I claim:

1. A cooler comprising an insulated container, a lid for closing said insulated container, insulated partition means for separating the interior of said container into at least two compartments, one of said compartments being centrally located, said insulated partition means interposed between said two compartments to define a significant portion of a boundary between said compartments and a coolant means defining a further portion of said boundary, said coolant means being supported on the top of said one compartment, a first portion of the surface of said cooling means in communication with said one compartment and a second portion of said cooling means in communication with at least another of said compartments in a manner such that said first portion absorbs heat from said one compartment and said second portion absorbs heat from said another compartment.

2. A cooler as defined in claim 1 wherein said coolant means, comprises a discrete coolant container, supported by said partition means, said coolant container being removable to provide access to said one compartment.

3. A cooler as defined in claim 1 or 2 wherein said partition means is integral with said insulated container.

4. A cooler as defined in claim 1 wherein said insulated container has an outside wall in the form of a pair of substantially parallel side walls interconnected at each end by a pair of tapering walls meeting at an apex, said partition means isolating a pair of end substantially triangular compartments forming said other compartments from a substantially rectangular central compartment forming said one compartment, said partition means housing to said partition walls integral with said outside wall but extending from a bottom of said insulated container only part way up said side walls and being substantially perpendicular to said side walls, top edges on said partition walls adapted to seat said coolant means, said coolant means comprising a coolant container shaped to seat on said top edges with a portion thereof projecting into said central chamber and forming said one portion of said surface.

5. A cooler as defined in claim 1 wherein said insulated container has a peripheral outer wall, said partition means being formed by an annular central wall spaced from said peripheral wall and defining a central chamber forming said one chamber, said central wall having an upper surface forming a seat to support said coolant means, said coolant means being a coolant container having a portion thereof forming said first portion of said surface extending into said central compartment.

6. A cooler as defined in claim 5 further comprising a plurality of substantially radial projections extending between and dividing the space between said peripheral wall and said annular wall into a plurality of compartments forming other compartments of said at least two compartments, portions of the surface of said coolant container forming said other portions being in communication with each of said plurality of compartments.

7. A cooler as defined in claim 5 wherein said annular wall is separate and discrete from said insulated container and includes a bottom section extending radially outward from said annular wall and terminating at said peripheral wall, said bottom wall being supported on a ledge means formed in said peripheral wall.

8. A cooler as defined in claim 2 wherein said insulated container has a peripheral wall and wherein said insulated partition means has a bottom section supported at said peripheral wall and a central wall spaced from said peripheral wall, said central wall having an upper surface forming a seat to peripherally support said coolant container.

9. A cooler as defined in claim 2 wherein said partition means has an upper surface and wherein said coolant container is formed with a step at its bottom peripheral edge adapted to seat on said upper surface.

* * * * *